US005366793A

United States Patent [19]

Fitts, Jr. et al.

[11] Patent Number: 5,366,793

[45] Date of Patent: Nov. 22, 1994

[54] ANISOTROPIC NONWOVEN FIBROUS WEB

[76] Inventors: James R. Fitts, Jr., 8930 Bridgewater Dr., Gainesville, Ga. 30506; William D. Musselwhite, 95 Bobwhite Trail, Canton, Ga. 30114; Eugenio G. Varona, 3309 Woodrun Trail, Marietta, Ga. 30062; Robert D. Wright, 1740 Beverly Wood Ct., Atlanta, Ga. 30341

[21] Appl. No.: 864,808

[22] Filed: Apr. 7, 1992

[51] Int. Cl.[5] ..... B32B 27/14

[52] U.S. Cl. ..... 428/198; 156/167; 428/114; 428/152; 428/219; 428/224; 428/283; 428/284; 428/288; 428/294; 428/297; 428/298; 428/326; 428/903

[58] Field of Search ..... 428/224, 284, 288, 292, 428/903, 297, 294, 114, 219, 283, 316, 152, 198, 298; 156/167

[56] References Cited

U.S. PATENT DOCUMENTS

| | | | |
|---|---|---|---|
| 2,357,392 | 9/1944 | Francis, Jr. | 18/47.5 |
| 2,464,301 | 3/1949 | Francis, Jr. | 154/46 |
| 2,483,405 | 10/1949 | Francis, Jr. | 154/54 |
| 2,957,852 | 10/1960 | Frankenburg et al. | 260/75 |
| 3,371,668 | 3/1968 | Johnson | 128/290 |
| 3,439,085 | 4/1969 | Hartmann | 264/210 |
| 3,468,748 | 9/1969 | Bassett | 161/122 |
| 3,575,782 | 5/1972 | Hansen | 161/141 |
| 3,676,242 | 7/1972 | Prentice | 156/62.4 |
| 3,689,342 | 9/1972 | Vogt et al. | 156/167 |
| 3,752,613 | 8/1973 | Vogt et al. | 425/80 |
| 3,773,590 | 11/1973 | Morgan | 156/244 |
| 3,806,289 | 4/1974 | Schwarz | 425/72 |
| 3,836,416 | 9/1974 | Ropiequet | 428/221 |
| 3,849,241 | 11/1974 | Butin et al. | 161/169 |
| 3,890,184 | 6/1975 | Morgan | 156/244 |
| 3,978,185 | 8/1976 | Buntin et al. | 264/93 |
| 4,107,364 | 8/1978 | Sisson | 428/196 |
| 4,209,563 | 6/1980 | Sisson | 428/288 |
| 4,259,220 | 3/1981 | Bunnelle et al. | 260/27 |
| 4,302,495 | 11/1981 | Marra | 428/110 |
| 4,303,571 | 12/1981 | Jansen et al. | 260/33.6 |
| 4,323,534 | 4/1982 | DesMarais | 264/176 |
| 4,375,446 | 3/1983 | Fujii et al. | 264/518 |
| 4,418,123 | 11/1983 | Bunnelle et al. | 428/517 |
| 4,543,099 | 9/1985 | Bunnelle et al. | 604/385 |
| 4,552,795 | 11/1985 | Hansen et al. | 428/110 |
| 4,640,859 | 2/1987 | Hansen et al. | 428/105 |
| 4,656,081 | 4/1987 | Ando et al. | 428/233 |
| 4,657,802 | 4/1987 | Morman | 428/152 |
| 4,663,220 | 5/1987 | Wisneski et al. | 428/221 |
| 4,692,371 | 9/1987 | Morman et al. | 428/224 |
| 4,769,279 | 9/1988 | Graham | 428/296 |
| 4,777,080 | 10/1988 | Harris, Jr. et al. | 428/212 |
| 4,804,577 | 2/1989 | Hazelton et al. | 428/224 |
| 4,874,447 | 10/1989 | Hazelton et al. | 156/167 |
| 4,892,903 | 1/1990 | Himes | 524/488 |
| 4,910,064 | 3/1990 | Sabee | 428/113 |
| 4,977,011 | 12/1990 | Smith | 428/152 |
| 4,988,560 | 1/1991 | Meyer et al. | 428/297 |
| 5,230,701 | 7/1993 | Meyer et al. | 602/76 |

FOREIGN PATENT DOCUMENTS

| | | |
|---|---|---|
| 0123545 | 10/1984 | European Pat. Off. . |
| 0457905A1 | 11/1991 | European Pat. Off. . |
| 0341875B1 | 11/1993 | European Pat. Off. . |
| 3824983A1 | 2/1989 | Germany . |
| 9216364 | 10/1992 | WIPO . |
| 9216371 | 10/1992 | WIPO . |

*Primary Examiner*—James J. Bell

*Attorney, Agent, or Firm*—Karl V. Sidor; Michael U. Lee

[57] ABSTRACT

Disclosed is an anisotropic elastomeric nonwoven fibrous web composed of a substantially homogeneous distribution of elastomeric meltblown fibers that are physically aligned along one of the planar dimensions of the web. The anisotropic elastomeric nonwoven web of meltblown fibers has a strength index of at least about 2. Also disclosed is process of making such an anisotropic elastomeric nonwoven web of meltblown fibers as well as a composite elastic material which contains an anisotropic elastomeric nonwoven web of meltblown fibers.

21 Claims, 5 Drawing Sheets

ANISOTROPIC NONWOVEN FIBROUS WEB

FIELD OF THE INVENTION

The present invention relates to a nonwoven fibrous material and a method of making the same.

BACKGROUND OF THE INVENTION

In the past, nonwoven webs of meltblown fibers formed using conventional techniques have been considered to be relatively isotropic, especially when compared to nonwoven webs such as, for example, bonded carded webs. The isotropic properties of nonwoven meltblown fiber webs have been considered advantageous in situations where nonwoven web must withstand forces applied in more than one direction.

However, in some situations nonwoven webs of meltblown fibers are subjected to forces applied in only one direction. Thus, it would be desirable to have a nonwoven web of meltblown fibers that is anisotropic. That is, the nonwoven web of meltblown fibers could have different physical properties (e.g., strength, and/or stretch and recovery) in different direction. For example, it would be desirable to have a nonwoven web of meltblown fibers possessing specified levels of physical properties in only the direction that those properties were needed.

An exemplary situation where such an anisotropic nonwoven web of meltblown fibers would be desirable is in certain types of elastomeric composite materials referred to as stretch-bonded laminates. A stretch-bonded laminate is made by joining a nonelastic material to an elastic sheet while the elastic sheet is in a stretched condition so that when the elastic sheet is relaxed, the nonelastic material gathers between the locations where it is bonded to the elastic sheet. The resulting material is stretchable to the extent that the nonelastic material gathered between the bond locations allows the elastic sheet to elongate. An example of this type of material is disclosed, for example, by U.S. Pat. No. 4,720,415 to Vander Wielen et al., issued Jan. 19, 1988.

In many applications, stretch bonded laminates are adapted to stretch and recover in only one direction such as, for example, the machine direction. Thus, the elastic component of the laminate does not have to be isotropic. That is, the elastic component need not have the same stretch and recovery properties in every direction. Desirably, the elastic component would have the required stretch and recovery properties in only the direction that the gathered nonelastic material allows the laminate to stretch. For example, if the fibers of an elastomeric wed of meltblown fibers were generally aligned in only one direction to provide a specified measure of one or more physical properties, such as tension, in that one direction, then relatively fewer elastomeric meltblown fibers could be used than if the web was isotropic. Since elastomeric materials generally tend to be quite expensive, reducing the amount of elastomeric material while still achieving the desired physical properties would be desirable. This is an important consideration since nonwoven webs of meltblown fibers can be used as economical and efficient substitutes for woven or knit textile materials and, in some cases, nonwoven materials such as bonded carded webs. For example, nonwoven webs of meltblown fibers are particularly useful in certain applications in garment materials, pads, diapers and personal care products where an item may be manufactured so inexpensively that it may be economical to discard the product after only one or a limited number of uses.

Although anisotropic nonwoven webs of meltblown fibers are disclosed by U.S. Pat. No. 4,656,081, those webs can be characterized by a heterogenous arrangement of fibers and fiber bundles. In particular, that patent discloses a material having a heterogenous organization in that yarn-like fiber bundles outnumber the fine fibers on one surface of the material and fine fibers outnumber the yarn-like fiber bundles on the other surface of the material. While U.S. Pat. No. 4,656,081 indicates that the material may be made by melt-blowing processes, the heterogenous nature of the material and the presence of yarn-like fiber bundles indicate relative poor web formation which may yield poor web properties that offset any advantage obtained by orienting the fibers.

Accordingly, there is still a need for an anisotropic nonwoven web having a substantially homogenous arrangement of meltblown fibers generally aligned in one of the planar dimensions of the web. Additionally, there is still a need for an inexpensive composite elastic material which is suited for high-speed manufacturing processes and which contains an elastic component that provides the desired elastic properties to the composite only in the one direction of stretch and recovery.

DEFINITIONS

The term "elastic" is used herein to mean any material which, upon application of a biasing force, is stretchable, that is, elongatable at least about 60 percent (i.e., to a stretched, biased length which is at least about 160 percent of its relaxed unbiased length), and which, will recover at least 55 percent of its elongation upon release of the stretching, elongating force. A hypothetical example would be a one (1) inch sample of a material which is elongatable to at least 1.60 inches and which, upon being elongated to 1.60 inches and released, will recover to a length of not more than 1.27 inches. Many elastic materials may be elongated by much more than 60 percent (i.e., much more than 160 percent of their relaxed length), for example, elongated 100 percent or more, and many of these will recover to substantially their initial relaxed length, for example, to within 105 percent of their original relaxed length, upon release of the stretching force.

The term "nonelastic" as used herein refers to any material which does not fall within the definition of "elastic," above. The terms "recover" and "recovery" as used herein refer to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches, the material would be elongated 50 percent (0.5 inch) and would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its one-half (0.5) inch elongation. Recovery may be expressed as [(maximum stretch length—final sample length)/(maximum stretch length—initial sample length)]$\times$100.

The term "machine direction" as used herein refers to the planar dimension of a nonwoven fibrous web which is in the direction of travel of the forming surface onto which fibers are deposited during formation of the web.

The term "cross-machine direction" as used herein refers to the planar dimension of a nonwoven fibrous web which is in the direction that is perpendicular to the machine direction defined above.

The term "strength index" as used herein means a ratio of the peak load of a material in the machine direction (MD) with the peak load of that same material in the cross-machine direction (CD). The term is also meant to encompass a ratio of the tensile load in the machine direction (MD) at a given elongation with the tensile load of that same material in the cross-machine direction (CD) at the same elongation. Typically, the strength index may be determined from a ratio of the peak load in both the machine and cross-machine directions. In that case, the strength index may be expressed by the following equation:

$$\text{strength index} = (\text{MD peak load}/\text{CD peak load})$$

A material having a machine direction (MD) peak load (or tensile load at a specified elongation) greater than its cross-machine direction (CD) peak load (or tensile load at the same elongation) will have a strength index that is greater than one (1). A material having a machine direction peak load (or tensile load at a specified elongation) less than its cross-machine direction peak load (or tensile load at the same elongation) will have a strength index that is less than one (1).

The term "isotropic" as used herein refers to a material characterized by a strength index ranging from about 0.5 to about two (2).

The term "anisotropic" as used herein refers to a material characterized by a strength index which is less than about "0.5" or greater than about two (2). For example, an anisotropic nonwoven web may have a strength index of about 0.25 or about three (3).

The term "substantially homogenous" as used herein refers to uniform and even distribution of fibrous material within a nonwoven fibrous web such that each face of the nonwoven fibrous web contains about the same mixture of fibrous materials. An example of such a substantially homogenous web may be seen in FIGS. 3 through 6 in which there is little or no observable difference between the mixture of fibrous materials present on the wire side and the die tip side of the illustrated anisotropic nonwoven webs of meltblown fibers. An example of a material which is not substantially homogenous is illustrated by U.S. Pat. No. 4,656,081.

The term "composite elastic material" as used herein refers to a multilayer material having at least one elastic layer joined to at least one gatherable layer at least at two locations in which the gatherable layer is gathered between the locations where it is joined to the elastic layer. A composite elastic material may be stretched to the extent that the nonelastic material gathered between the bond locations allows the elastic material to elongate. This type of composite elastic material is disclosed, for example, by U.S. Pat. No. 4,720,415 to Vander Wielen et al., issued Jan. 19, 1988, which is hereby incorporated by reference.

The term "stretch-to-stop" as used herein refers to a ratio determined from the difference between the unextended dimension of a composite elastic material and the maximum extended dimension of a composite elastic material upon the application of a specified tensioning force and dividing that difference by the unextended dimension of the composite elastic material. If the stretch-to-stop is expressed in percent, this ratio is multiplied by 100. For example, a composite elastic material having an unextended length of 5 inches and a maximum extended length of 10 inches upon applying a force of 2000 grams has a stretch-to-stop (at 2000 grams) of 100 percent. Stretch-to-stop may also be referred to as "maximum non-destructive elongation". Unless specified otherwise, stretch-to-stop values are reported herein at a load of 2000 grams.

The term "tenacity" as used herein refers to the resistance to elongation of a composite elastic material which is provided by its elastic component. Tenacity is the tensile load of a composite elastic material at a specified strain (i.e., elongation) for a given width of material divided by the basis weight of that composite material's elastic component as measured at about the composite material's stretch-to-stop elongation. For example, tenacity of a composite elastic material is typically determined in one direction (e.g., machine direction) at about the composite material's stretch-to-stop elongation. Elastic materials having high values for tenacity are desirable in certain applications because less material is needed to provide a specified resistance to elongation than a low tenacity material. For a specified sample width, tenacity is reported in units of force divided by the units of basis weight of the elastic component. This provides a measure of force per unit area and is accomplished by reporting the thickness of the elastic component in terms of its basis weight rather than as an actual caliper measurement. For example, reported units may be $\text{grams}_{force}$ (for a specific sample width)/grams per square meter. Unless specified otherwise, all tenacity data is reported for the first extension of a three (3) inch wide sample having a four (4) inch gauge length.

As used herein, the term "nonwoven web" means a web having a structure of individual fibers or threads which are interlaid, but not in an identifiable, repeating manner. Nonwoven webs have been, in the past, formed by a variety of processes such as, for example, meltblowing processes, spunbonding processes and bonded carded web processes.

As used herein, the term "autogenous bonding" means bonding provided by fusion and/or self-adhesion of fibers and/or filaments without an applied external adhesive or bonding agent. Autogenous bonding may be provided by contact between fibers and/or filaments while at least a portion of the fibers and/or filaments are semi-molten or tacky. Autogenous bonding may also be provided by blending a tackifying resin with the thermoplastic polymers used to form the fibers and/or filaments. Fibers and/or filaments formed from such a blend can be adapted to self-bond with or without the application of pressure and/or heat. Solvents may also be used to cause fusion of fibers and filaments which remains after the solvent is removed.

As used herein, the term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S.

Pat. No. 3,849,241 to Butin, the disclosure of which is hereby incorporated by reference.

As used herein, the term "microfibers" means small diameter fibers having an average diameter not greater than about 100 microns, for example, having an average diameter of from about 0.5 microns to about 50 microns, or more particularly, microfibers may have an average diameter of from about 4 microns to about 40 microns.

As used herein, the term "spunbonded fibers" refers to small diameter fibers which are formed by extruding a molten thermoplastic material as filaments from a plurality of fine, usually circular, capillaries of a spinnerette with the diameter of the extruded filaments then being rapidly reduced as by, for example, eductive drawing or other well-known spun-bonding mechanisms. The production of spun-bonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "superabsorbent" refers to absorbent materials capable of absorbing at least 10 grams of aqueous liquid (e.g. distilled water per gram of absorbent material while immersed in the liquid for 4 hours and holding substantially all of the absorbed liquid while under a compression force of up to about 1.5 psi.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates and materials added to enhance processability of the composition.

SUMMARY OF THE INVENTION

Problems associated with previous nonwoven webs have been addressed by the anisotropic nonwoven web meltblown fibers of the present invention. The anisotropic nonwoven fibrous web is composed of a substantially homogenous distribution of meltblown fibers which are generally aligned in one planar dimension of the web such as, for example, the machine direction of the web. The present invention also encompasses a process of making an anisotropic nonwoven fibrous web containing a substantially homogenous arrangement of meltblown fibers which are generally aligned along one planar dimension of the web. Generally speaking, the process includes the steps of: providing a stream of gas-borne meltblown fibers; and directing the stream of meltblown fibers onto a forming surface at a contact angle from about 10 to about 60 degrees to the forming surface with minimum dispersion of the gas-borne meltblown fibers. For example, the first stream may be deflected to an angle from about 25 to about 45 degrees to the forming surface to produce the anisotropic web of meltblown fibers that are generally aligned along one planar dimension of the web, e.g., the machine direction of the web. Generally speaking, deflecting the stream of gas-borne meltblown fibers may be accomplished by any technique which provide a shallow contact angle with minimum dispersion of the gas-borne meltblown fibers. For example, a first stream of gas-borne meltblown fibers may be deflected at an impingement point above the forming surface with a second stream of gas to the desired angle. Alternatively and/or additionally, the meltblown die head and/or the forming surface may be slanted to produce the desired contact angle. Generally speaking, dispersion of the stream of gas-borne meltblown fibers may be minimized by selecting a proper forming distance and controlling air suction beneath the forming surface. Where the steam of gas-borne meltblown fibers is deflected by a second gas stream, dispersion can be minimized by properly selecting a point of impingement.

In another aspect of the process of the present invention, the anisotropic nonwoven fibrous web may be formed directly upon at least one layer of a material such as, for example, a knit fabric, woven fabric and/or nonwoven fabric. The nonwoven fabric may be, for example, an elastomeric web of meltblown fibers.

The meltblown fibers of an anisotropic web may be a polymer selected from the group consisting of elastomeric and non-elastomeric thermoplastic polymers. The non-elastomeric polymer may be any suitable fiber forming resin including, for example, polyolefins, non-elastomeric polyesters, non-elastomeric polyamides, and cellulosic derived polymers. The elastomeric polymer may be any suitable elastomeric fiber forming resin including, for example, elastomeric polymers such as elastic polyesters, elastic polyurethanes, elastic polyamides, elastic copolymers of ethylene and at least one vinyl monomer, and elastic A-B-A′ block copolymers wherein A and A′ are the same or different thermoplastic polymer, and wherein B is an elastomeric polymer block. These resins may be blended with a variety of additives and processing aids to produce desired characteristics.

According to one aspect of the present invention, the anisotropic nonwoven fibrous web may have a strength index of more than 2. More particularly, the anisotropic fibrous web may have a strength index of more than about 3. The anisotropic web of the present invention may have a basis weight of, for example, from about 10 to about 400 gsm. More particularly, the web may have a basis weight of from about 20 to about 200 gsm. Even more particularly, the web may have a basis weight of from about 30 to about 50 gsm.

In one aspect of the present invention, the anisotropic web of meltblown fibers may contain a mixture of meltblown fibers and one or more other materials such as, for example, wood pulp, nonelastic fibers, particulates or super-absorbent materials and/or blends of such materials.

According to the present invention, the anisotropic nonwoven web of meltblown fibers may be incorporated into a multilayer material. For example, the anisotropic web may be joined with at least one other textile fabric, knit fabric, nonwoven fabric, film or combination thereof. As a further example, if the anisotropic web is an elastomeric web of meltblown fibers, it may be a component of a composite elastic material in which the elastomeric web is joined to a gatherable layer at spaced apart locations so that the gatherable layer is gathered between the spaced-apart locations.

Generally speaking, it is desirable that the anisotropic elastomeric web component of such a composite elastic material have a machine direction tenacity (one inch wide strip) of at least about 14 $grams_{force}$/grams per square meter at about the material's stretch-to-stop elongation. For example, the anisotropic elastomeric web component may have a machine direction tenacity (one inch wide strip) ranging from about 15 to about 30 $grams_{force}$/grams per square meter at about the material's stretch-to-stop elongation.

DETAILED DESCRIPTION OF THE INVENTION

The present invention provides an anisotropic nonwoven web containing a substantially homogenous distribution of meltblown fibers generally aligned in a similar direction. For example, the anisotropic nonwoven web is composed of a substantially homogenous distribution of meltblown fibers which are generally aligned along one planar dimension of the web, e.g., the machine direction of the web.

Figure 1:
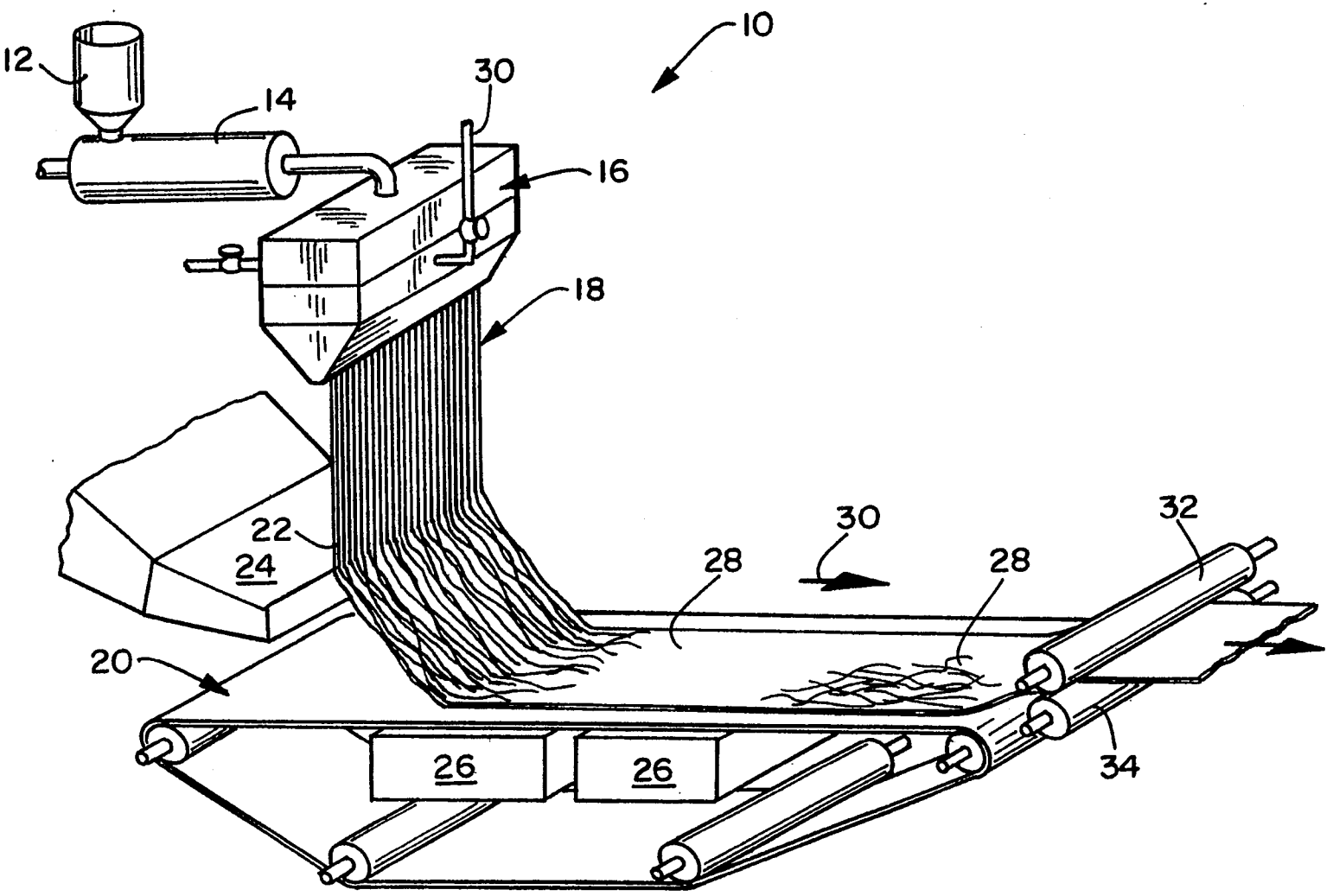
FIG. 1 is a schematic drawing of an exemplary process for forming an anisotropic elastic web of meltblown fibers.

Referring now to the drawings wherein like reference numerals represent the same or equivalent structure and, in particular, to FIG. 1 of the drawings, there is schematically illustrated at 10 an exemplary process of making an anisotropic nonwoven fibrous web containing a substantially homogenous arrangement of meltblown fibers generally aligned along one planar dimension of the web, e.g., the machine direction of the web. Generally speaking, the process includes the steps of: (1) providing a stream of gas-borne meltblown fibers; and (2) directing the stream of meltblown fibers so that the stream contacts a forming surface at an angle from about 10 to about 60 degrees to the forming surface with minimum dispersion of the gas-borne fibers. It is contemplated that the stream of gas-borne meltblown fibers may be formed utilizing a variety of conventional meltblowing techniques. Meltblowing techniques generally involve extruding a thermoplastic polymer resin through a plurality of small diameter capillaries of a meltblowing die as molten threads into a heated gas stream (the primary air stream) which is flowing generally in the same direction as that of the extruded threads so that the extruded threads are attenuated, i.e., drawn or extended, to reduce their diameter. Such meltblowing techniques, and apparatus therefor, are discussed fully in U.S. Pat. No. 4,663,220, the contents of which are incorporated herein by reference. In forming the fibers used in the fibrous web, pellets or chips, etc. (not shown) of an extrudable polymer are introduced into a pellet hopper 12 of an extruder 14.

The extruder has an extrusion screw (not shown) which is driven by a conventional drive motor (not shown). As the polymer advances through the extruder, due to rotation of the extrusion screw by the drive motor, it is progressively heated to a molten state. Heating the polymer to the molten state may be accomplished in a plurality of discrete steps with its temperature being gradually elevated as it advances through discrete heating zones of the extruder 14 toward a meltblowing die 16. The meltblowing die 16 may be yet another heating zone where the temperature of the thermoplastic resin is maintained at an elevated level for extrusion. Heating of the various zones of the extruder 14 and the meltblowing die may be achieved by any of a variety of conventional heating arrangements (not shown).

In the meltblown die arrangement 16, the position of air plates which, in conjunction with a die portion define chambers and gaps. Streams of attenuating gas converge to form a primary stream of gas which entrains and attenuates the molten threads, as they exit the orifices, into gas-borne fibers 18 or, depending upon the degree of attenuation, microfibers, of a small diameter which is usually less than the diameter of the orifices.

The primary stream of gas is typically a heated gas stream. For example, the gas stream may be heated to a temperature of ranging from about 250 to about 600 degrees Fahrenheit. The pressure of the primary stream of gas may be adjusted so that it is powerful enough to attenuate the extruded polymer threads into fibers and yet avoid undesirable dispersion and scattering of the fibers when the fibers are collected into a coherent nonwoven web. For example, the pressure of the primary air stream may range from about 0.25 to about 15 pounds per square inch, gauge. When the primary gas stream is impinged by a secondary gas stream, the pressure of the primary air stream is desirably about 0.5 to about 1.5 psi. More particularly, the pressure of the primary air stream may be about 1.0 psi.

In one embodiment, the gas-borne fibers or microfibers 18 are blown, by the action of the attenuating gas, toward a collecting arrangement which, in the embodiment illustrated in FIG. 1, is a foraminous endless belt 20.

The gas-borne fibers and microfibers 18 from die arrangement 10 are impinged by a secondary gas stream 22 exiting an air duct 24 before the gas-borne fibers or microfibers 18 reach the foraminous endless belt 20. The secondary gas stream 22 deflects the stream of gas-borne fibers or microfibers 18 at an angle to the belt 20.

The secondary gas stream 22 may be, for example, an air stream generated by fans that supply a quench air stream to the meltblowing apparatus through an air duct. The secondary gas stream 22 may also be compressed air or any other gas which is compatible with the meltblown fibers and may be released via an orifice or nozzle. It is contemplated that additives and/or other materials may be entrained in the secondary gas stream to treat the meltblown fibers.

Air pressure in the air duct 24 is maintained at a level sufficient to cause the stream of meltblown fibers and microfibers 18 to deflect when that stream is impinged by the secondary air stream 22. For example, the air pressure in the air duct 24 may range from about 2 to about 5 inches of water column. More particularly, the air pressure may be at a setting of about 3.5 inches of water column. The velocity of the secondary air stream 22 as it exits the air duct 24 is also adjusted to provide sufficient energy to deflect the stream of meltblown fibers and microfibers 24. For example, the velocity of the secondary air stream 22 may range from about 8,000 to about 16,000 feet per minute. Desirably, the velocity of the secondary air stream 22 is at about 12,000 feet per minute. In one embodiment of the invention, the width of the secondary air nozzle is about one-half inch and the length of the nozzle is about the same length as the meltblowing die itself.

The exit orifice or nozzle of the air duct 24 transporting the secondary air stream 22 may be located, for example, from about 1.5 to 5 inches off to one side of the stream of meltblown fibers and microfibers 18. Desirably, the nozzle may be located from about 2.5 to about 3.5 inches from the stream of meltblown fibers and microfibers 18.

The impingement point (i.e., the point where the secondary air stream 22 impacts the stream of meltblown fibers and microfibers 18) should be located so that the deflected stream had only a minimum distance to travel to reach the forming surface to minimize dispersion of the entrained fibers and microfibers. For example, the distance from the impingement point to the forming surface may range from about 2 to about 12 inches. Desirably, the distance from the impingement point to the forming surface may range from about 5 to about 8 inches. The distance from the impingement point to the meltblowing die tip should also be set at a distance which minimizes dispersion of the stream of fibers and microfibers. For example, this distance may range from about 2 to about 8 inches. Desirably, this distance may be about 4 inches.

Generally speaking, the dispersion of the stream of gas-borne meltblown fibers 18 may be minimized by selecting a proper vertical forming distance before the stream of fibers contacts the forming surface. A shorter vertical forming distance is generally desirable for minimizing dispersion. This must be balanced by the need for the extruded fibers to solidify from their tacky, semi-molten state before contacting the forming surface 20. For example, the vertical forming distance may range from about 3 to about 15 inches from the meltblown die tip. Desirably, this vertical distance may be about 7 to about 11 inches from the die tip.

In some situations, it may be desirable to cool the secondary air stream 22. Cooling the secondary air stream could accelerate the quenching of the molten or tacky meltblown fibers and provide for shorter distances between the meltblowing die tip and the forming surface which could be used to minimize fiber dispersion and enhance the substantially homogenous distribution of the generally aligned meltblown fibers that form the web. For example, the temperature of the secondary air stream 22 may be cooled to about 15 to about 85 degrees Fahrenheit.

Using the secondary air stream 22 as described above, and also adjusting the meltblowing jet primary air stream yields a deflected gas-borne stream of meltblown fibers and microfibers 18. By this balancing of primary and secondary air pressures, the desired angle of impingement of meltblown fibers to the wire may be obtained, resulting in increased machine direction orientation while retaining a substantially homogenous distribution of meltblown fibers.

Dispersion may also be minimized by controlling air suction beneath the forming surface. It is desirable to use vacuum boxes 26 beneath the forming surface to draw the meltblown fibers or microfibers onto the forming surface. The vacuum may be set at about 1 to about 4 inches of water column.

The meltblown fibers are collected as a coherent nonwoven web 28 on the surface of the foraminous endless belt 20 which is rotating as indicated by the arrow 30 in FIG. 1. At least a portion of the entangled fibers or microfibers 18 autogenously bond to other fibers or microfibers because they are still somewhat tacky or molten while they are deposited on the endless belt 20. It may be desirable to lightly calender the anisotropic fibrous web of meltblown fibers 28 in order to enhance the autogenous bonding. This calendering may be accomplished with a pair of patterned or un-patterned pinch rollers 32 and 34 under sufficient pressure (and temperature, if desired) to cause permanent autogenous bonding between the meltblown fibers.

The contact angle or angle between the stream of gas-borne fibers and the endless belt 20 may range from about 10 to about 60 degrees. For example, the stream of gas-borne fibers may be deflected so that it contacts the belt 25 at an angle from about 20 to about 45 degrees. More particularly, the stream of gas-borne fibers may be deflected so that it contacts the belt 26 at an angle from about 30 to about 35 degrees.

Of course, the stream of gas-borne meltblown fibers may be deflected by any technique which provides a shallow contact angle with minimum dispersion of the gas-borne meltblown fibers, and the process of the present invention should not be limited only to a technique in which a first stream of gas-borne meltblown fibers 18 is deflected at an impingement point above the forming surface with a secondary gas stream 22. Alternatively and/or additionally, the meltblown die arrangement 16 and/or the forming surface 20 may be slanted to produce the desired contact angle. For example, the stream of gas-borne meltblown fibers or microfibers 18 may be directed toward the belt 20 at an angle other than 90 degrees. If desired, the stream of meltblown fibers or microfibers 18 may then be impinged by the secondary gas stream 22 to deflect the meltblown fibers or microfibers 18 before they are collected on the foraminous endless belt 20. As a further example, the foraminous endless belt 20 may be adjusted so that it is positioned at an angle to the direction of the stream of gas-borne fibers 18.

Although the inventors should not be held to a particular theory of operation, it is believed that deflecting a stream of gas-borne fibers or microfibers to contact a foraminous endless belt under controlled vacuum conditions provides a coherent, substantially homogenous nonwoven web of meltblown fibers or microfibers generally aligned along one planar dimension of the web, e.g., the machine direction of the web, at least because (1) minimum dispersion of the stream of gas-borne of meltblown fibers can be achieved by using a second gas stream to deflect the gas-borne fibers or microfibers; (2) the second gas stream acts to help align the gas-borne fibers in generally one direction; (3) the shallow contact angle between the deflected gas-borne stream of fibers or microfibers and the foraminous endless belt acts to help align the gas-borne fibers in generally one direction; and (4) air suction beneath the forming wire acts to help align the gas-borne fibers in generally one direction and control the dispersion of the gas-borne fibers as they are collected on the forming surface.

The anisotropic web of meltblown fibers may be formed utilizing one or more conventional meltblowing die arrangements which have been modified to provide the desired fiber orientation and uniform fiber distribution. The modified die arrangements may be arranged in series and/or may be alternated with one or more conventional meltblowing apparatus or web-forming means that produce substantially isotropic nonwoven webs. For example, the anisotropic nonwoven web of meltblown fibers may be deposited directly on a substantially isotropic web of meltblown fibers. Alternatively, a first anisotropic web of meltblown fibers may be deposited on a foraminous surface and other anisotropic webs and/or isotropic webs of meltblown fibers may be formed directly upon the first web. Various combinations of process equipment may be set up to produce different types of fibrous webs. For example, the fibrous web may contain alternating layers of anisotropic and isotropic meltblown fibers. Several dies for forming meltblown fibers may also be arranged in series to provide superposed layers of fibers. It is also contemplated that the anisotropic nonwoven fibrous web may be formed directly upon at least one layer of a material such as, for example, a knit fabric, woven fabric and/or film.

The meltblown fibers of an anisotropic web may be a polymer selected from the group consisting of elastomeric and non-elastomeric thermoplastic polymers. The non-elastomeric polymer may be any suitable non-elastomeric fiber forming resin or blend containing the same. For example, such polymers include polyolefins, non-elastomeric polyesters, non-elastomeric polyamides, cellulosic derived polymers, vinyl chlorides and polyvinyl alcohols.

The elastomeric polymer may be material that can be manufactured into meltblown fibers and/or microfibers. Generally, any suitable elastomeric fiber forming resins or blends containing the same may be utilized for the elastomeric meltblown fibers. The fibers may be formed from the same or different elastomeric resin.

For example, the elastomeric meltblown fibers may be made from block copolymers having the general formula A-B-A' where A and A' are each a thermoplastic polymer endblock which contains a styrenic moiety such as a poly (vinyl arene) and where B is an elastomeric polymer midblock such as a conjugated diene or a lower alkene polymer. The block copolymers may be, for example, (polystyrene/poly(ethylenebutylene)/polystyrene) block copolymers available from the Shell Chemical Company under the trademark KRATON® G. One such block copolymer may be, for example, KRATON® G-1657.

Other exemplary elastomeric materials which may be used include polyurethane elastomeric materials such as, for example, those available under the trademark ESTANE from B. F. Goodrich & Co., polyamide elastomeric materials such as, for example, those available under the trademark PEBAX from the Rilsan Company, and polyester elastomeric materials such as, for example, those available under the trade designation Hytrel from E. I. DuPont De Nemours & Company. Formation of elastomeric meltblown fibers from polyester elastic materials is disclosed in, for example, U.S. Pat. No. 4,741,949 to Morman et al., hereby incorporated by reference. Useful elastomeric polymers also include, for example, elastic copolymers of ethylene and at least one vinyl monomer such as, for example, vinyl acetates, unsaturated aliphatic monocarboxylic acids, and esters of such monocarboxylic acids. The elastic copolymers and formation of elastomeric meltblown fibers from those elastic copolymers are disclosed in, for example, U.S. Pat. No. 4,803,117.

Processing aids may be added to the elastomeric polymer. For example, a polyolefin may be blended with the elastomeric polymer (e.g., the A-B-A elastomeric block copolymer) to improve the processability of the composition. The polyolefin must be one which, when so blended and subjected to an appropriate combination of elevated pressure and elevated temperature conditions, is extrudable, in blended form, with the elastomeric polymer. Useful blending polyolefin materials include, for example, polyethylene, polypropylene and polybutene, including ethylene copolymers, propylene copolymers and butene copolymers. A particularly useful polyethylene may be obtained from the U.S.I. Chemical Company under the trade designation Petrothene NA 601 (also referred to herein as PE NA 601 or polyethylene NA 601). Two or more of the polyolefins may be utilized. Extrudable blends of elastomeric polymers and polyolefins are disclosed in, for example, previously referenced U.S. Pat. No. 4,663,220.

Desirably, the elastomeric meltblown fibers should have some tackiness or adhesiveness to enhance autogenous bonding. For example, the elastomeric polymer itself may be tacky when formed into fibers or, alternatively, a compatible tackifying resin may be added to the extrudable elastomeric compositions described above to provide tackified elastomeric fibers that autogenously bond. In regard to the tackifying resins and tackified extrudable elastomeric compositions, note the resins and compositions as disclosed in U.S. Pat. No. 4,787,699, hereby incorporated by reference.

Any tackifier resin can be used which is compatible with the elastomeric polymer and can withstand the high processing (e.g., extrusion) temperatures. If the elastomeric polymer (e.g., A-B-A elastomeric block copolymer) is blended with processing aids such as, for example, polyolefins or extending oils, the tackifier resin should also be compatible with those processing aids. Generally, hydrogenated hydrocarbon resins are preferred tackifying resins, because of their better temperature stability. REGALREZ TM and ARKON TM P series tackifiers are examples of hydrogenated hydrocarbon resins. ZONATAK TM 501 lite is an example of a terpene hydrocarbon. REGALREZ TM hydrocarbon resins are available from Hercules Incorporated. ARKON TM P series resins are available from Arakawa Chemical (U.S.A.) Incorporated. Of course, the present invention is not limited to use of such three tackifying resins, and other tackifying resins which are compatible with the other components of the composition and can withstand the high processing temperatures, can also be used.

Typically, the blend used to form the elastomeric fibers include, for example, from about 40 to about 80 percent by weight elastomeric polymer, from about 5 to about 40 percent polyolefin and from about 5 to about 40 percent resin tackifier. For example, a particularly useful composition included, by weight, about 61 to about 65 percent KRATON TM G-1657, about 17 to about 23 percent polyethylene NA 601, and about 15 to about 20 percent REGALREZ TM 1126.

According to the present invention, the anisotropic nonwoven web may also include a substantially homogenous mixture of meltblown fibers and other fibrous materials and/or particulates. For an example of such a mixture, reference is made to U.S. Pat. No. 4,209,563, incorporated herein by reference, in which meltblown fibers and other fibrous materials are commingled to form a single coherent web of randomly dispersed fibers. Another example of such a composite web would be one made by a technique such as disclosed in previously referenced U.S. Pat. No. 4,741,949. That patent discloses a nonwoven material which includes a mixture of meltblown thermoplastic fibers and other materials. The fibers and other materials are combined in the gas stream in which the meltblown fibers are borne so that an intimate entangled commingling of meltblown fibers and other materials, e.g., wood pulp, staple fibers or particulates such as, for example, activated charcoal, clays, starches, or hydrocolloid (hydrogel) particulates commonly referred to as super-absorbents occurs prior to collection of the fibers upon a collecting device to form a coherent web of randomly dispersed fibers.

Figure 2:
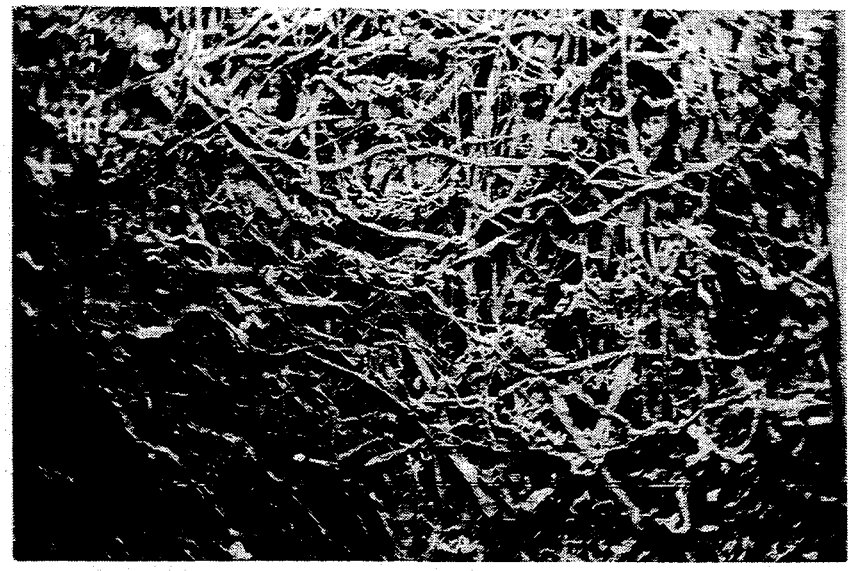
FIG. 2 is a photomicrograph of an isotropic nonwoven web containing a generally isotropic nonwoven web of randomly distributed meltblown fibers.

FIG. 2 is an approximately 8.5X photomicrograph of a conventionally formed nonwoven web of meltblown fibers. As can be seen from the photograph, the nonwoven web contains a generally random distribution of meltblown fibers and microfibers.

Figure 3:
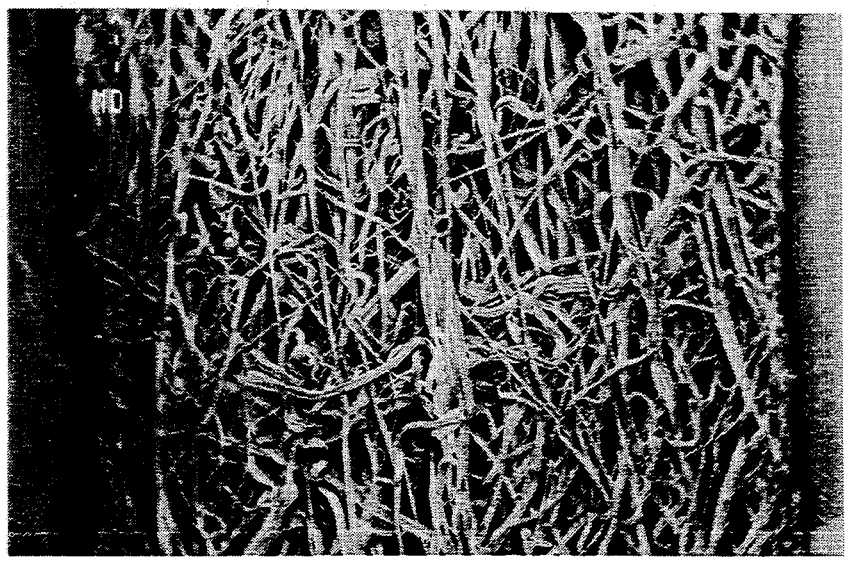
FIG. 3 is a photomicrograph of an exemplary anisotropic nonwoven web containing a substantially homogenous distribution of meltblown fibers that are generally aligned along the machine direction of the web.

FIG. 3 is an approximately 10X photomicrograph of the die tip side of an exemplary anisotropic nonwoven web of elastomeric meltblown fibers that was formed according to the present invention. The meltblown fibers were formed from a KRATON ® series A-B-A' elastomeric block copolymer available from the Shell Chemical Company, Houston, Tex. It can be seen from the photomicrograph that the meltblown fibers and microfibers are generally aligned from the top to the bottom of the figure which corresponds to the machine direction of the web.

Figure 4:
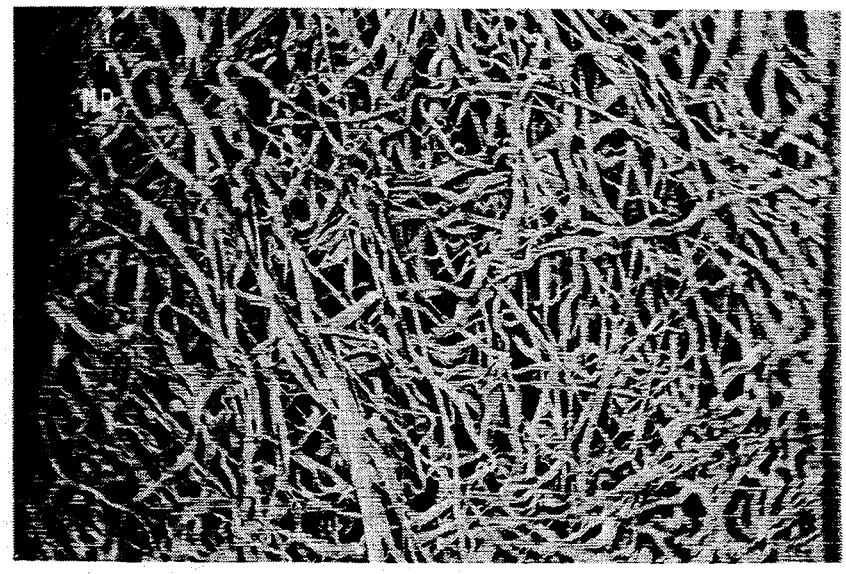
FIG. 4 is a photomicrograph of an exemplary anisotropic nonwoven web containing a substantially homogenous distribution of meltblown fibers that are generally aligned along the machine direction of the web.

FIG. 4 is an approximately 10X photomicrograph of the wire side (i.e., the side opposite to that shown in FIG. 3) of an exemplary anisotropic nonwoven web of elastomeric meltblown fibers formed according to the present invention. It can be seen from the photomicrograph that the elastomeric meltblown fibers and microfibers are generally aligned from the top to the bottom of the figure which corresponds to the machine direction of the web. Importantly, the distribution of meltblown fibers and microfibers is substantially the same on both the die tip side and the wire side of the nonwoven web. That is, each face of the nonwoven web contains substantially the same mix of meltblown fibers and microfibers. Such a homogenous and uniform distribution of meltblown fibers in a nonwoven fabric is believed to be important at least to provide uniform physical properties and to avoid fabric failure caused by weak spots or areas of poor formation.

Figure 5:
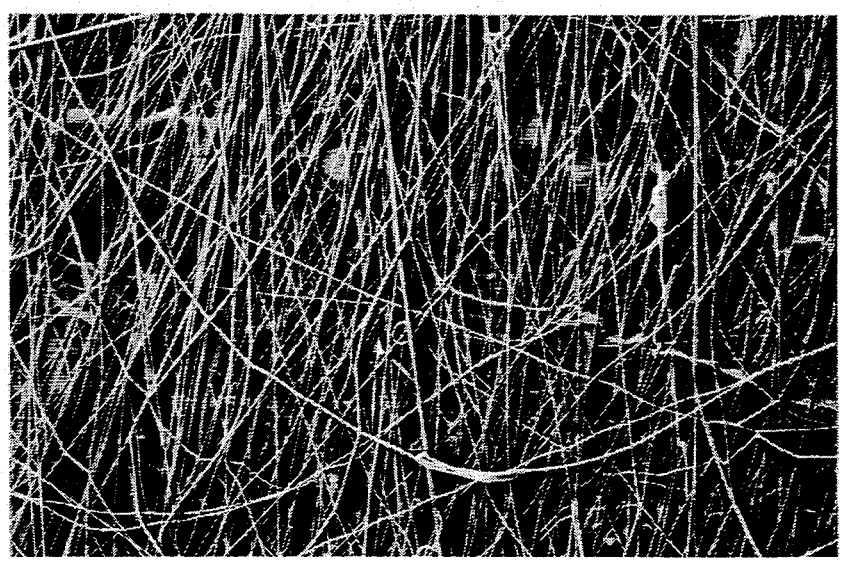
FIG. 5 is a photomicrograph of an exemplary anisotropic nonwoven web containing a substantially homogenous distribution of meltblown fibers that are generally aligned along the machine direction of the web.

FIG. 5 is an approximately 40X photomicrograph of the die tip side of an exemplary anisotropic nonwoven web of non-elastomeric meltblown fibers that was formed according to the present invention. The meltblown fibers were formed from a conventional isotactic polypropylene suitable for meltblowing. It can be seen from the photomicrograph that the meltblown fibers and microfibers are generally aligned from the top to the bottom of the figure which corresponds to the machine direction of the web.

Figure 6:
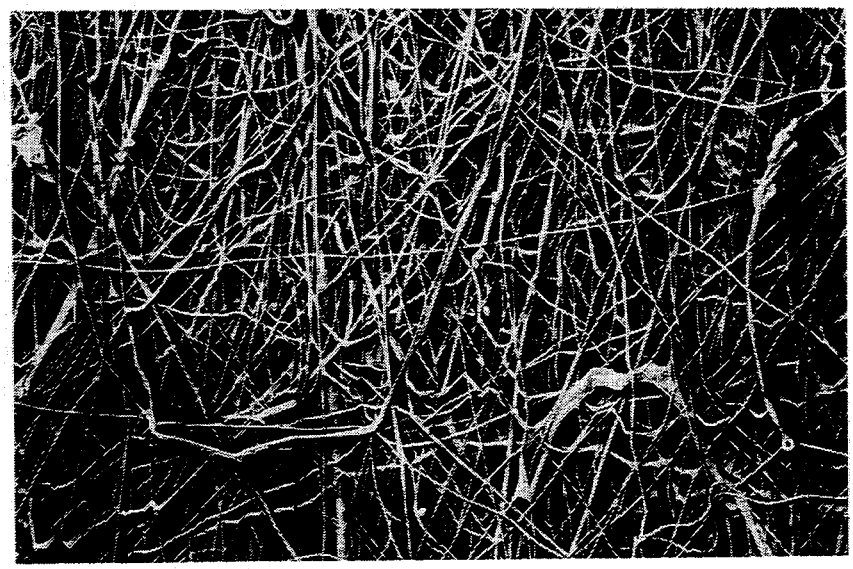
FIG. 6 is a photomicrograph of an exemplary anisotropic nonwoven web containing a substantially homogenous distribution of meltblown fibers that are generally aligned along the machine direction of the web.

FIG. 6 is an approximately 40X photomicrograph of the wire side (i.e., the side opposite to that shown in FIG. 5) an exemplary anisotropic nonwoven web of non-elastomeric meltblown fibers formed according to the present invention. It can be seen from the photomicrograph that the meltblown fibers and microfibers are generally aligned from the top to the bottom of the figure which corresponds to the machine direction of the web. Importantly, the distribution of meltblown fibers and microfibers is substantially the same on both the die tip side and the wire side of the nonwoven web. That is, each face of the nonwoven web contains substantially the same mix of meltblown fibers and microfibers. Such a homogenous and uniform distribution of meltblown fibers in a nonwoven fabric is believed to be important at least to provide uniform physical properties and to avoid fabric failure caused by weak spots or areas of poor formation.

In one aspect of the present invention, an anisotropic elastic fibrous web may be incorporated into a composite elastic material. Generally speaking, a composite elastic material is a multilayer material having at least one elastic layer joined to at least one gatherable layer at least at two locations in which the gatherable layer is gathered between the locations where it is joined to the elastic layer. A composite elastic material may be stretched to the extent that the nonelastic material gathered between the bond locations allows the elastic material to elongate. This type of composite elastic material is disclosed, for example, by U.S. Pat. No. 4,720,415 to Vander Wielen et al., issued Jan. 19, 1988, which is hereby incorporated by reference.

One type of a composite elastic material is referred to as a stretch-bonded laminate. Such a laminate may be made as generally described in U.S. Pat. No. 4,720,415. For example, an anisotropic elastomeric fabric can be unwound from a supply roll and passed through a nip of an S-roll arrangement. The elastic fabric may also be formed in-line and passed directly through the nip without first being stored on a supply roll.

The elastic web is passed through the nip of the S-roll arrangement in a reverse-S path. From the S-roll arrangement, the elastic web passes through the pressure nip formed by a bonder roller arrangement. Additional S-roll arrangements (not shown) may be introduced between the S-roll arrangement and the bonder roller arrangement to stabilize the stretched material and to control the amount of stretching. Because the peripheral linear speed of the rollers of the S-roll arrangement is controlled to be less than the peripheral linear speed of the rollers of the bonder roller arrangement, the elastic web is tensioned between the S-roll arrangement and the pressure nip of the bonder roll arrangement. By adjusting the difference in the speeds of the rollers, the elastic web is tensioned so that it stretches a desired amount and is maintained in such stretched condition Simultaneously, a first and second gatherable layer is unwound from a supply roll and passed through the nip of the bonder roller arrangement. It is contemplated that the first gatherable layer and/or the second gatherable layer may be formed in-line by extrusion processes such as, for example, meltblowing processes, spunbonding processes or film extrusion processes and passed directly through the nip without first being stored on a supply roll.

The first gatherable layer and second gatherable layer are joined to the elastic web (while the web is maintained in its elongated condition) during their passage through the bonder roller arrangement to form a composite elastic material (i.e., stretch-bonded laminate).

The stretch-bonded laminate immediately relaxes upon release of the tensioning force provided by the S-roll arrangement and the bonder roll arrangement, whereby the first gatherable layer and the second gatherable layer are gathered in the stretch-bonded laminate. The stretch-bonded laminate is then wound up on a winder.

EXAMPLES

Anisotropic Elastic Fibrous Web

An exemplary anisotropic elastomeric web of meltblown fibers was made utilizing a five-bank meltblowing process. The meltblowing equipment was set-up to extrude an elastomeric composition which contained about 63 percent, by weight, KRATON TM G-1657, about 17 percent, by weight, polyethylene NA 601, and about 20 percent, by weight, REGALREZ TM 1126. Meltblowing banks 1 and 2 were set-up to produce conventional isotropic elastomeric webs of meltblown fibers; banks 3, 4 and 5 were each set-up to form anisotropic elastomeric webs containing a substantially homogenous distribution of meltblown fibers. Each bank contained an extrusion tip having 0.016 inch diameter holes spaced at a density of about 30 capillary per lineal inch.

Polymer was extruded from each bank at a rate of about 0.58 grams per capillary per minute (about 3.2 pounds per linear inch per hour) at a height of about 12 inches above the forming surface. A primary air-flow of about 14 $ft^3$/minute per inch of meltblowing die at a pressure of about 3 psi and a temperature of about 510 ° F. was used for banks 1 and 2. For banks 3, 4 and 5, the primary air-flow was about 9 $ft^3$/minute per inch of meltblowing die at a pressure of about 1 psi and a temperature of about 510° F.

In banks 1 and 2, the primary air-flow was used to attenuate the extruded polymer into meltblown fibers and microfibers that were collected on a foraminous surface moving at a constant speed.

The meltblown fibers from bank 1 formed a substantially isotropic elastomeric nonwoven web and was carried downstream on the foraminous surface to bank 2 where a substantially isotropic elastomeric nonwoven web was formed directly onto the web formed by bank 1.

The foraminous surface carrying the isotropic webs passed under bank 3. That bank was equipped with a secondary air stream to deflect the primary stream of gas-borne fibers and microfibers so that the gas stream was directed onto the forming surface at an angle of about 30 degrees (i.e., 30 degrees to the plane of the forming surface). The secondary air stream exited a ½ inch wide slot in a nozzle that ran about the entire length of the meltblowing die tip. The secondary air nozzle was positioned between banks 2 and 3 at about 3 inches to the side of the primary stream of gas-borne fibers and microfibers. The secondary air exited the nozzle at a velocity of about 12,000 feet per second, a pressure of about 3 inches of water column, and a temperature of about 60 degrees Fahrenheit. The secondary air stream impinged the primary stream at a point about 4 inches below the meltblowing die tip and about 6 inches above the forming surface. Air suction beneath the forming surface was about 2.5 inches of water column. Meltblown fibers and microfibers were collected on the forming surface with minimum dispersion of the fiber stream yielding a layer of meltblown fibers generally aligned along the machine direction and having a substantially homogenous distribution.

Banks 4 and 5 were set up identically to bank 3, and a layer of meltblown fibers was deposited from each bank onto the forming surface. The resulting multilayer material contained two conventionally formed isotropic nonwoven webs of meltblown fibers and three anisotropic nonwoven webs of meltblown fibers. The layers of the structure were joined by autogenous bonding produced by directly forming one layer upon the other and enhanced by the tackifier resin added to the polymer blend.

The following physical properties of the multi-layer material were measured: basis weight, peak load, and peak strain (i.e., peak elongation). Results for measurements taken in the machine direction of five (5) samples are given in Table 1 and results corresponding to cross-machine direction measurements of five (5) other samples are given in Table 2. Table 3 lists the ratios of peak load measurements (i.e., Strength Index) taken in the machine and cross-machine directions.

TABLE 1

| | MACHINE DIRECTION PROPERTIES | | | |
|---|---|---|---|---|
| SAMPLE ID | BASIS WEIGHT (gsm) | (TENSION) PEAK LOAD[1] (Grams) | PEAK STRAIN (%) | TENSION PER GSM @ PEAK LOAD |
| 1 | 373.3 | 7088.2 | 849.0 | 19.0 |
| 2 | 356.5 | 6128.8 | 805.5 | 17.2 |
| 3 | 352.6 | 6044.0 | 833.3 | 17.1 |
| 4 | 299.7 | 5165.0 | 807.3 | 17.2 |
| 5 | 330.7 | 5602.3 | 804.9 | 16.9 |

TABLE 2

| | CROSS-MACHINE DIRECTION PROPERTIES | | | |
|---|---|---|---|---|
| SAMPLE ID | BASIS WEIGHT (gsm) | (TENSION) PEAK LOAD[1] (Grams) | PEAK STRAIN (%) | TENSION PER GSM @ PEAK LOAD |
| 6 | 343.6 | 2005.7 | 782.3 | 5.8 |
| 7 | 351.3 | 2043.6 | 822.2 | 5.8 |
| 8 | 351.3 | 2025.8 | 826.6 | 5.8 |
| 9 | 316.5 | 1818.3 | 752.1 | 5.7 |

TABLE 2-continued

| SAMPLE ID | CROSS-MACHINE DIRECTION PROPERTIES BASIS WEIGHT (gsm) | (TENSION) PEAK LOAD[1] (Grams) | PEAK STRAIN (%) | TENSION PER GSM @ PEAK LOAD |
|---|---|---|---|---|
| 10 | 321.6 | 1932.1 | 827.7 | 6.0 |

TABLE 3

| SAMPLE NUMBERS | MD/CD STRENGTH INDEX (from TENSION PER GSM @ PEAK LOAD)[1] |
|---|---|
| 1 and 6 | 3.3 |
| 2 and 7 | 3.0 |
| 3 and 8 | 3.0 |
| 4 and 9 | 3.0 |
| 5 and 10 | 2.8 |
| Average | 3.0 |

[1]= Sample tested in Sintech 2 computerized testing system, gauge length was 2 inches and sample length was 2 inches.

It is contemplated that greater Strength Index values could be obtained by having higher proportion of anisotropic elastomeric fibrous web in the multi-layer material.

Control Elastic Fibrous Web

The control elastomeric nonwoven web of meltblown fibers was a substantially isotropic nonwoven web of elastomeric meltblown fibers identified as DEMIQUE ® elastic nonwoven fabric available from the Kimberly-Clark Corporation of Neenah, Wisconsin. This nonwoven fabric contains elastomeric meltblown fibers formed from an elastomeric polyetherester available as ARNITEL ® EM-400 from DSM Engineering Plastics, North America of Reading Pennsylvania. The following properties were measured for that material: basis weight, peak load, and peak strain (i.e., peak elongation). Peak load and peak strain were measured in both the machine and cross-machine directions. Those measurements as well as a ratio of machine direction to cross machine peak load (i.e., Strength Index) are reported in Table 4.

TABLE 4

| CONTROL ELASTOMERIC NONWOVEN WEB OF MELTBLOWN FIBERS | |
|---|---|
| BASIS WEIGHT (grams/square meter) | 48 |
| MACHINE DIRECTION PEAK LOAD (grams) | 1802 |
| CROSS-MACHINE DIRECTION PEAK LOAD (grams) | 1560 |
| MACHINE DIRECTION PEAK STRAIN (%) | 442 |
| CROSS-MACHINE DIRECTION PEAK STRAIN (%) | 472 |
| MD/CD STRENGTH INDEX @ PEAK LOAD | 1.15 |

Stretch-bonded Laminate

Several composite elastomeric materials referred to as stretch-bonded laminates were made utilizing various elastomeric nonwoven webs of meltblown fibers formed from an elastomeric composition which contained about 63 percent, by weight, KRATON TM G-1657, about 17 percent, by weight, polyethylene NA 601, and about 20 percent, by weight, REGALREZ TM 1126. The elastomeric nonwoven webs of meltblown fibers were formed utilizing the processes described above to produce either single layer or multilayer materials of containing: (a) one or more relatively isotropic elastomeric nonwoven webs; (b) anisotropic elastomeric nonwoven webs having a substantially homogenous distribution of meltblown fibers generally aligned along one planar dimension of the web, e.g., the machine direction of the web; or (c) combinations of relatively isotropic and anisotripc nonwoven webs of meltblown fibers.

The elastomeric nonwoven webs were formed under the conditions reported in Table 5. Generally speaking, the elastomeric nonwoven web(s) of meltblown fibers were carried by the foraminous wire at a specified rate, lifted off the wire by a pick-off roll moving at a faster rate and then drawn to the calender/wire draw ratio specified in Table 5. At this extension the drawn elastomeric nonwoven web of meltblown fibers was fed into a calender roller along with upper and lower non-elastic web facings. Each facing was a conventional polypropylene spunbond web having a basis weight 0.4 ounces per square yard (about 14 gsm) which was joined to the elastomeric nonwoven web of meltblown fibers at spaced apart locations to form a stretch-bonded laminate structure. The stretched-bonded laminate was relaxed as it exited the nip so that gathers and puckers would form in the gatherable material and the elastomeric component contracted to generally about its prestretched dimensions. The laminate was wound onto a driven wind-up roll under slight tension.

Tensile Testing

Tensile properties of the stretch-bonded laminates were measured on a Sintech 2 computerized material testing system available from Sintech, Incorporated of Stoughton, Mass. Sample sizes were either about 3 inches by 7 inches (the 7 inch dimension was in the machine direction) or about 2.125 inches by 7 inches as reported in Table 5, gauge length was 100 mm (about 4 inches), stop load was set at 2000 grams, and the crosshead speed was about 500 millimeters per minute.

Figure 7:
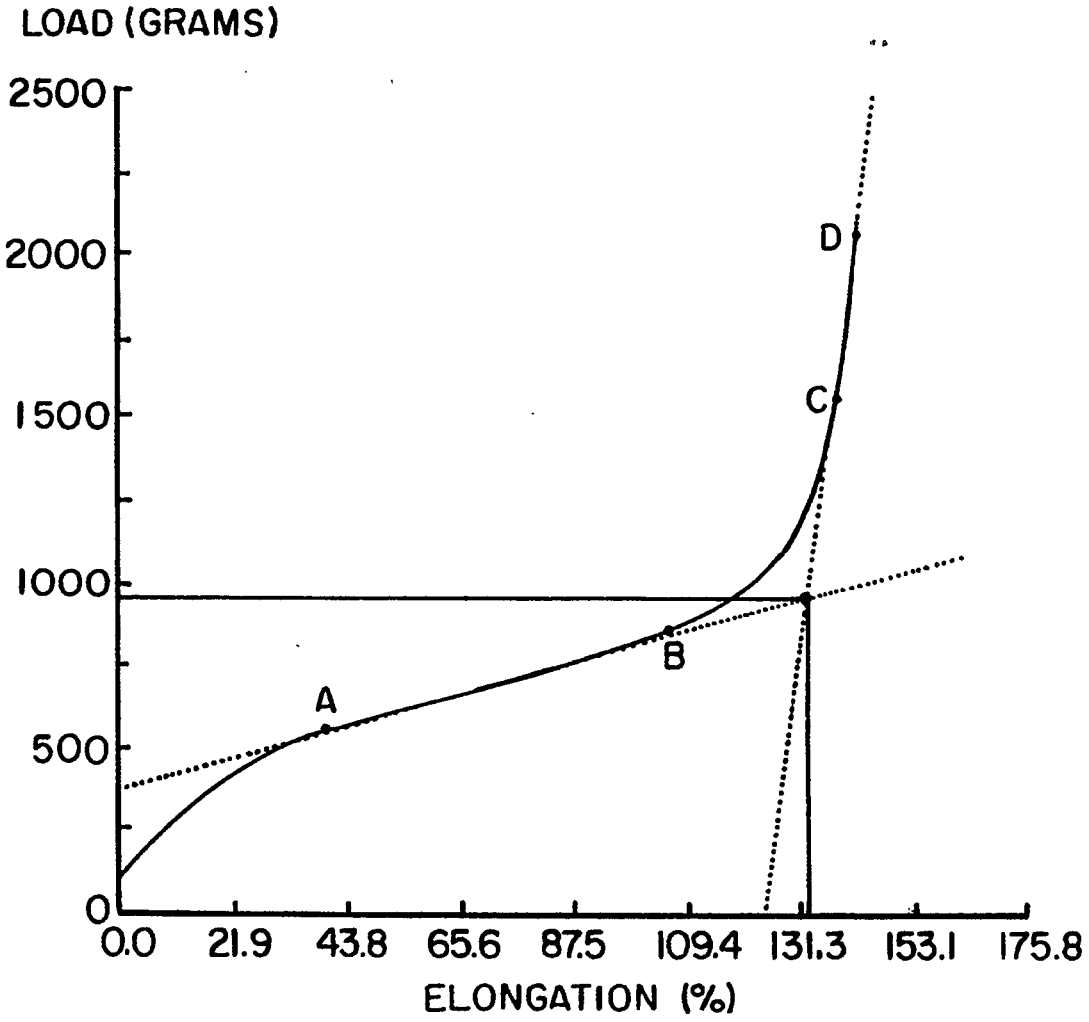
FIG. 7 is a graph of load versus elongation determined during tensile testing of an exemplary stretch-bonded laminate.

Data from the Sintech 2 system was used to generate load versus elongation curves for each stretch-bonded laminate sample. FIG. 7 is a representation of an exemplary load versus elongation curve for the initial elongation of a stretch bonded laminate to a maximum applied load of 2000 grams. As can be seen from the graph, the slope of the line tangent to the curve between points A and B represents the general elongation versus load characteristics provided primarily by the elastic component of the stretch bonded laminate.

The slope of the load versus elongation curve increases substantially once the stretch-bonded laminate has been fully extended to eliminate the gathers or puckers in the laminate. This region of substantial increase in slope occurs at about the laminate's stretch-to-stop elongation. The slope of the line tangent to the curve between points C and D after this region represents the general elongation versus load characteristics provided primarily by the non-elastic component (i.e., the gatherable web) of the stretch-bonded laminate.

The intersection of the lines passing through A-B and C-D is referred to as the point of intercept. Load and elongation values reported at this point (i.e., load at intercept and elongation at intercept) for different stretch-bonded laminates made under the same conditions (e.g., materials, draw ratios, etc.) are believed to provide a reliable comparison. Tenacity reported for each sample is the load at the point of intercept for the specified sample width divided by the basis weight of the material's elastic component at stretch-to-stop (i.e., at a 2000 gram load). The basis weight of the elastic component at stretch-to-stop is approximately the same as its basis weight at the point of intercept (i.e., stretch at intercept).

This basis weight of the elastic component at stretch-to-stop was calculated by measuring the relaxed or unstretched basis weight of the elastic component (separated from the stretch-bonded laminate) and then dividing that number by the stretch-bonded laminate's stretch-to-stop elongation expressed as a percentage of the laminate's initial length. For example, a stretch-bonded laminate (4 inch gauge length) having a stretch-to-stop of about 11.2 inches (7.2 inches or 180 percent elongation) has a stretch-to-stop elongation that is about 280 percent of its initial 4 inch gauge length. The basis weight of the elastic component at the stretch-to-stop elongation would be its relaxed basis weight (i.e., separated from the stretch-bonded laminate) divided by 280 percent.

TABLE 5

STRETCH-BONDED LAMINATE PROCESS CONDITIONS AND PROPERTIES

| Sample ID | Total Banks | # of CMB Banks[1] | # of AK Banks[2] | Extrusion Rate, PIH Per Bank[3] | Melt Temp[4] | Forming Distance In Inches | Cal/Wire Draw Ratio | Impingement Angle (Degrees)[5] | Basis Wt. @ S-T-S gsm[6] |
|---|---|---|---|---|---|---|---|---|---|
| 11 | 1 | 1 | 0 | 2 | 480 | 10 | 4.6 | 90 | 39.2 |
| 12 | 1 | 0 | 1 | 2 | 480 | 10 | 4.6 | 20 | 83.7 |
| 13 | 7 | 7 | 0 | 3.4 | 515 | 11 | 5.4 | 90 | 21.8 |
| 14 | 6 | 6 | 0 | 3.4 | 515 | 11 | 5.4 | 90 | 17.9 |
| 15 | 6 | 3 | 3 | 3.4 | 515 | 9 | 5.4 | 30 | 17.7 |
| 16 | 4 | 4 | 0 | 3.2 | 510 | 10 | 4.3 | 90 | 36.0 |
| 17 | 3 | 3 | 0 | 2.3 | 510 | 10 | 4.9 | 90 | 22.8 |
| 18 | 3 | 2 | 1 | 2.3 | 510 | 10 | 4.9 | 35 | 22.1 |

| Sample ID | Tension L @ I, gms[7] | Composite Tenacity, g L @ I/bwt[8] | Sample Width, in. | Composite Normalized Tenacity Per Inch | Calculated Tenacity due to AK Component[9] |
|---|---|---|---|---|---|
| 11 | 760 | 19.4 | 2.125 | 8.99 | |
| 12 | 2794 | 33.0 | 2.125 | 15.53 | 15.53 |
| 13 | 792 | 36.3 | 3.000 | 12.10 | |
| 14 | 669 | 37.4 | 3.000 | 12.46 | |
| 15 | 950 | 53.7 | 3.000 | 17.90 | 23.33 |
| 16 | 785 | 21.8 | 2.125 | 10.26 | |
| 17 | 639 | 28.1 | 2.125 | 13.22 | |
| 18 | 694 | 31.4 | 2.125 | 14.78 | 17.9 |

[1]= Number of conventional meltblowing banks
[2]= Number of anisotropic meltblowing banks
[3]= Pounds of polymer per linear inch of die tip per hour
[4]= Degrees °F.
[5]= Angle between stream of gas-borne meltblown fibers and the forming surface
[6]= Basis weight at stretch-to-stop elongation in grams per square meter
[7]= Load at intercept, grams
[8]= Tension/basis weight force
[9]= Calculation based on weight ratio of composite to the anisotropic component and the weight ratio of the isotropic component to the anisotropic component The load, elongation and tenacity values reported in Table 5 are averages for 12 samples. As can be seen from Table 5, the composite elastic material (i.e., stretch-bonded laminate) containing the anisotropic elastic fibrous web provides a load at intercept which is greater than that of the Control material (i.e., containing the isotropic elastomeric nonwoven web) at similar elongations for similar basis weights. This is reflected in the increased tenacity values reported for Samples 12, 15 and 18.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An anisotropic nonwoven fibrous web comprising a substantially homogenous arrangement of meltblown fibers generally aligned along one of the planar dimensions of the web.

2. The anisotropic web of claim 1 wherein the meltblown fibers comprise a polymer selected from the group consisting of elastomeric and non-elastomeric thermoplastic polymers.

3. The anisotropic web of claim 2 wherein the non-elastomeric polymer is selected from the group consisting of polyolefins, non-elastomeric polyesters, non-elastomeric polyamides, cellulosic derived polymers, vinyl chloride polymers and vinyl alcohol polymers.

4. The anisotropic web of claim 2 wherein the elastomeric polymer is selected from the group consisting of elastomeric polyesters, elastomeric polyurethanes, elastomeric polyamides, elastomeric copolymers of ethylene and at least one vinyl monomer, and elastomeric A-B-A′ block copolymers wherein A and A′ are the same or different thermoplastic polymer, and wherein B is an elastomeric polymer block.

5. The anisotropic web of claim 1 wherein the web has a strength index of more than 2.

6. The anisotropic web of claim 1 wherein the web has a strength index of more than about 3.

7. The anisotropic web of claim 1 wherein the meltblown fibers include meltblown microfibers

8. The anisotropic web of claim 1 having a basis weight ranging from about 10 to about 400 gsm.

9. The anisotropic web of claim 4 wherein the elastomeric polymer is blended with a processing aid.

10. The anisotropic web of claim 4 wherein the elastomeric polymer is blended with a tackifying resin.

11. The anisotropic web of claim 10 wherein the blend further includes a processing aid.

12. The anisotropic web of claim 1 wherein the meltblown fibers further comprises a mixture of meltblown fibers and one or more other materials selected from the group consisting of wood pulp, staple-type fibers, particulates and super-absorbent materials.

13. The anisotropic web of claim 12, wherein the staple-type fibers are selected from the group consisting of polyester fibers, polyamide fibers, glass fibers, polyolefin fibers, cellulosic derived fibers, multi-component fibers, natural fibers, absorbent fibers, electrically conductive fibers or blends of two or more of said fibers.

14. The anisotropic web of claim 12, wherein said particulate materials are selected from the group consisting of activated charcoal, clays, starches and metal oxides.

15. A multi-layer material comprising at least one layer of the anisotropic web of claim 1 and at least one other layer of material.

16. A composite elastic material adapted to provide improved tenacity in one direction, the composite material comprising:

an anisotropic elastomeric nonwoven web comprising a substantially homogenous arrangement of elastomeric meltblown fibers generally aligned along one of the planar dimensions of the web, and at least one gatherable layer joined at spaced apart locations to the anisotropic elastomeric nonwoven fibrous web so that the gatherable layer is gathered between the spaced-apart locations.

17. The composite elastic material of claim 16 wherein the gatherable layer is a nonwoven web of fibers.

18. The composite elastic material of claim 16 wherein the gatherable layer is selected from the group consisting of a web of spunbonded fibers, a web of meltblown fibers, a bonded carded web of fibers, a multi-layer material including at least one of the webs of spunbonded fibers, meltblown fibers, and a bonded carded web of fibers.

19. The composite elastic material of claim 16, wherein the gatherable layer is a composite material comprising a mixture of fibers and one or more other materials selected from the group consisting of wood pulp, staple fibers, particulates and super-absorbent materials.

20. The composite elastic material of claim 16 wherein the nonwoven web elastomeric meltblown fibers has a machine direction tenacity for a 1 inch wide strip of at least about 15 $grams_{force}$/grams per square meter at about the composite elastic material's stretch-to-stop elongation.

21. The composite elastic material of claim 16 wherein the nonwoven web of elastomeric meltblown fibers has a machine direction tenacity for a 1 inch wide strip of from about 15 to about 25 $grams_{force}$/grams per square meter at about the composite elastic material's stretch-to-stop elongation.

* * * * *

UNITED STATES PATENT AND TRADEMARK OFFICE

CERTIFICATE OF CORRECTION

PATENT NO. : 5,366,793

DATED : Nov. 22, 1994

INVENTOR(S) : James R. Fitts, Jr., et al.

It is certified that error appears in the above-identified patent and that said Letters Patent is hereby corrected as shown below:

Column 1, line 53, "wed" should read --web--;

Signed and Sealed this

Twenty-first Day of May, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,366,793
DATED : November 22, 1994
INVENTOR(S) : James R. Fitts, Jr., et. al.

It is certified that error appears in the above-indentified patent and that said Letters Patent is hereby corrected as shown below:

Title page, item [73] Assignee: should read-- Kimberly-Clark Corporation Neenah, Wis.--

Signed and Sealed this

Twenty-seventh Day of August, 1996

*Attest:*

Bruce Lehman

BRUCE LEHMAN

*Attesting Officer*

*Commissioner of Patents and Trademarks*